US008100608B2

(12) United States Patent
Steffen

(10) Patent No.: US 8,100,608 B2
(45) Date of Patent: Jan. 24, 2012

(54) RETAINING WALL

(75) Inventor: Stephan Steffen, Bremen (DE)

(73) Assignee: SF-Kooperation GmbH Beton-Konzepte, Bremen (DE)

( * ) Notice: Subject to any disclaimer, the term of this patent is extended or adjusted under 35 U.S.C. 154(b) by 802 days.

(21) Appl. No.: 12/091,010

(22) PCT Filed: Sep. 30, 2006

(86) PCT No.: PCT/EP2006/009504

§ 371 (c)(1), (2), (4) Date: Aug. 21, 2008

(87) PCT Pub. No.: WO2007/045340

PCT Pub. Date: Apr. 26, 2007

(65) Prior Publication Data

US 2011/0135404 A1 Jun. 9, 2011

(30) Foreign Application Priority Data

Oct. 19, 2005 (DE) ..... 10 2005 050 456

(51) Int. Cl.
*E02D 29/02* (2006.01)

(52) U.S. Cl. ..... 405/286; 52/592.1; 52/604; 52/605; 405/284

(58) Field of Classification Search ..... 405/262, 405/284, 286; 52/590.2, 592.1, 603, 604, 52/605

See application file for complete search history.

(56) References Cited

U.S. PATENT DOCUMENTS 2,313,363 A * 3/1943 Schmitt ..... 405/286
2,462,289 A * 2/1949 Rochow ..... 52/605
3,873,225 A * 3/1975 Jakobsen et al. ..... 52/604
4,703,599 A * 11/1987 Pardo ..... 52/604
4,711,606 A * 12/1987 Leling et al. ..... 405/286
4,798,036 A * 1/1989 Pardo ..... 52/604
4,860,505 A * 8/1989 Bender ..... 405/286
4,993,206 A * 2/1991 Pardo ..... 405/286
5,017,049 A * 5/1991 Sievert ..... 405/286
5,114,270 A * 5/1992 Riddle ..... 405/284

(Continued)

FOREIGN PATENT DOCUMENTS

DE 81 33 364 2/1982

(Continued)

*Primary Examiner* — Frederic L Lagman

(74) *Attorney, Agent, or Firm* — Laurence P. Colton; Smith Risley Tempel Santos LLC

(57) ABSTRACT

A retaining wall, in particular a retaining wall (24) inclined against a soil backfill, composed of individual shaped blocks (20, 21, 22, 23), the shaped blocks (20, 21, 22, 23) being arranged one above the other in layers (30) and the shaped blocks (20, 21, 22, 23) of adjacent layers (30) each engaging in a form-fitting manner with one another in the region of upper sides (25) and lower sides (26) of the shaped blocks (20, 21, 22, 23). Provision is made according to the invention for upper sides (25) and lower sides (26) of the shaped blocks (20, 21, 22, 23) to be designed and/or oriented in such a way that when lateral pressure is exerted transversely to an imaginary longitudinal axis of the retaining wall (24), individual layers (30) can be displaced in the corresponding direction. In order to produce the form-fitting engagement transversely to the longitudinal axis of the retaining wall, provision is preferably made for the shaped blocks (20, 21, 22, 23) to be provided in the region of the upper side (25) and the lower side (26) with respective form-fitting means, in particular projections and/or offsets and/or oblique faces (31).

32 Claims, 10 Drawing Sheets

U.S. PATENT DOCUMENTS

| | | | | |
|---|---|---|---|---|
| 5,120,164 | A * | 6/1992 | Iacocca et al. | 405/286 |
| 5,607,262 | A * | 3/1997 | Martin | 405/286 |
| 5,622,456 | A * | 4/1997 | Risi et al. | 405/286 |
| 5,775,046 | A * | 7/1998 | Fanger et al. | 52/592.1 |
| 5,791,827 | A * | 8/1998 | Arvai et al. | 405/286 |
| 5,820,304 | A * | 10/1998 | Sorheim et al. | 405/286 |
| 6,053,661 | A * | 4/2000 | Lewis | 52/604 |
| 6,152,655 | A * | 11/2000 | Hull | 405/286 |
| 6,178,715 | B1 * | 1/2001 | Pacitto et al. | 52/604 |
| 6,443,663 | B1 * | 9/2002 | Scales et al. | 405/286 |
| 6,705,797 | B1 * | 3/2004 | Wada | 52/604 |
| 6,715,965 | B2 * | 4/2004 | Manthei et al. | 405/286 |
| 7,059,808 | B2 * | 6/2006 | Risi | 405/286 |
| 2004/0052588 | A1 * | 3/2004 | Keshmiri | 405/284 |
| 2005/0081470 | A1 | 4/2005 | Utsunomiya | |

FOREIGN PATENT DOCUMENTS

| | | | |
|---|---|---|---|
| DE | 35 05 530 | A1 | 8/1986 |
| DE | 85 04 505 | U1 | 9/1987 |
| DE | 88 11 825 | U1 | 11/1988 |
| DE | 94 05 552 | U1 | 7/1994 |
| DE | 196 54 529 | C2 | 7/1998 |
| DE | 200 00 821 | U1 | 6/2000 |
| DE | 100 02 390 | A1 | 7/2001 |
| DE | 100 06 364 | A1 | 8/2001 |
| DE | 203 13 254 | U1 | 11/2003 |
| EP | 05 69 323 | A2 | 11/1993 |
| EP | 06 16 655 | B1 | 9/1994 |
| FR | 2 268 116 | A1 | 11/1975 |
| JP | 11 036336 | A | 2/1999 |

* cited by examiner

Fig. 6
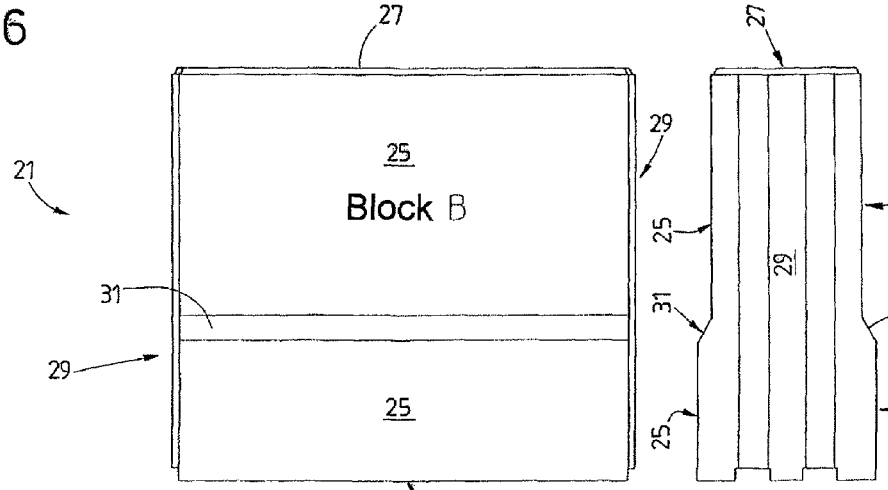
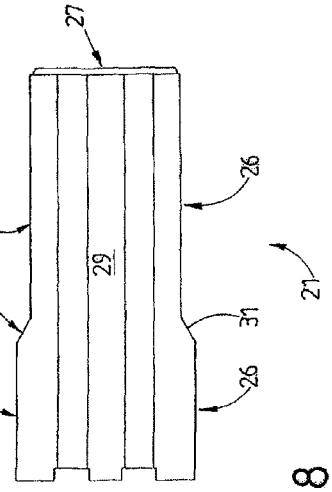
Fig. 8
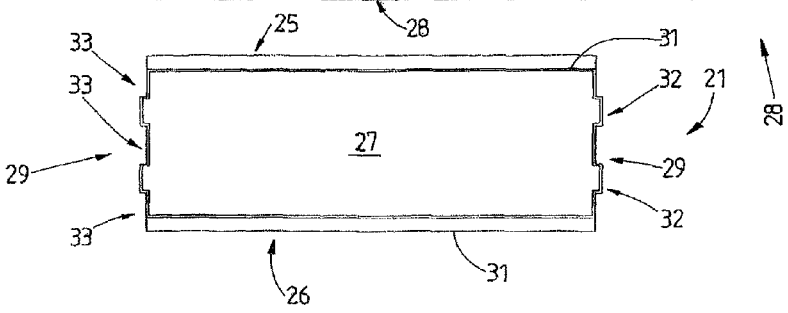
Fig. 7

Fig. 10
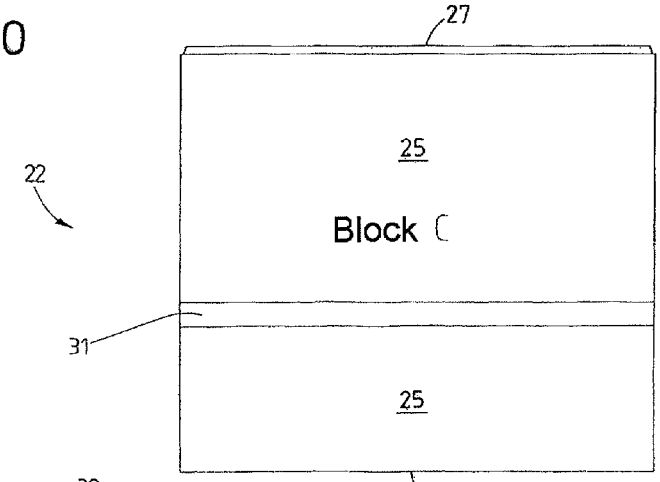
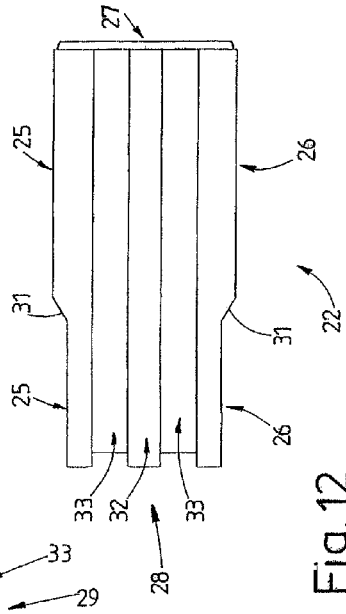
Fig. 12
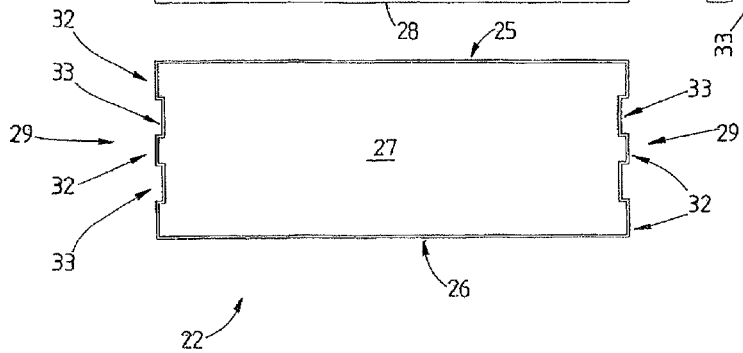
Fig. 11

RETAINING WALL

BACKGROUND OF THE INVENTION

1. Technical Field

The invention relates to a retaining wall, in particular a retaining wall inclined against a soil backfill, composed of individual shaped blocks, the shaped blocks being arranged one above the other in layers and the shaped blocks of adjacent layers each engaging in a form-fitting manner with one another in the region of upper sides and lower sides of the shaped blocks.

2. Prior Art

Such retaining walls are known from practice in numerous variants. It is known here both to bond together the layers of shaped blocks with mortar or to construct them as a so-called gravity retaining wall without mortar. It is also known to couple the individual shaped blocks of the retaining wall by means of connecting pieces.

A retaining wall of the type mentioned initially is known for example from German utility model 90 15 718, originating from the applicant. The form-fitting connection of the shaped blocks in the region of the upper sides and lower sides produces a bond within the layers. This results in a wall element which, due to the bond of the shaped blocks, can be viewed statically as a plate element. The same applies when the shaped blocks are mortared.

A problem with the above-described retaining wall is that the plate element can fail as a whole under varying loading, with the result that the retaining wall is damaged or even destroyed. Such loading variations can be produced, for example, by alternating loading by the soil backfill, in particular by alternating applied loads or alternating moisture states.

BRIEF SUMMARY OF THE INVENTION

Taking this as the starting point, the object on which the invention is based is to develop retaining walls of the type mentioned initially, in particular to propose retaining walls which better withstand loading variations.

To achieve this object, a retaining wall according to the invention is in particular a retaining wall inclined against a soil backfill, composed of individual shaped blocks, the shaped blocks being arranged one above the other in layers and the shaped blocks of adjacent layers each engaging in a form-fitting manner with one another in the region of upper sides and lower sides of the shaped blocks, characterized in that upper sides and lower sides of the shaped blocks are designed and/or oriented in such a way that when lateral pressure is exerted transversely to an imaginary longitudinal axis of the retaining wall, individual layers can be displaced in the corresponding direction. Provision is accordingly made for upper sides and lower sides of the shaped blocks to be designed and/or oriented in such a way that when lateral pressure is exerted transversely to the longitudinal axis of the retaining wall, individual layers can be displaced in the corresponding direction. This solution particularly has the advantage that the retaining wall does not form a single plate element as a whole, but that loading-induced displacement of individual layers can result in stress relief.

It is thus proposed that individual layers of shaped blocks interlocking in a form-fitting manner are displaced from the wall axis to prevent the retaining wall being destroyed as a whole. For this purpose, the shaped blocks are designed in such a way that a displacement is possible in spite of the form fit in the region of the upper sides and lower sides. This makes it possible to retain the advantages provided by the "keying" of the layers.

According to a preferred development of the invention, provision is made for shaped blocks arranged in the designated layer of the retaining wall to be designed to deviate from the shaped blocks of the respective adjacent layers in order to make possible a displacement of the shaped blocks. In other words, it is proposed that the shaped blocks from which the retaining wall is formed are not identical but can deviate from one another at least in layers. Provision is made in this respect for designated layers to contain specific shaped blocks which are in each case designed to deviate from the shaped blocks of adjacent layers. This allows the targeted arrangement of layers which can be displaced under loading variations. In this way, the construction of the retaining wall can be predetermined in a targeted manner from static viewpoints in order to avoid the risk of the whole retaining wall being damaged.

To produce the form fit between the layers, provision can preferably be made for the shaped blocks to be provided in the region of the upper side and the lower side with respective form-fitting means, in particular projections and/or offsets and/or oblique faces, for the form-fitting engagement of the shaped blocks of adjacent layers transversely to the longitudinal axis of the retaining wall. This ensures keying between the layers.

Provision is also preferably made for the form-fitting means of shaped blocks of adjacent layers to be designed to correspond to one another, the form-fitting means of the shaped blocks of individual layers being designed in such a way that when lateral pressure is exerted on an (upper or lower) layer, the pressure can be transmitted via the form-fitting means to shaped blocks of adjacent (central) layers, and the form-fitting means of other layers are designed so that they make it possible to absorb pressure from shaped blocks of adjacent layers but can be displaced from the wall axis, however, under direct lateral pressure.

In a preferred embodiment of the invention, provision is made for the upper side and lower side of the shaped blocks to have respective oblique faces formed thereon for form-fitting engagement with shaped blocks of adjacent layers, the oblique faces preferably each being arranged at a distance from a visible side and a rear side of the shaped blocks.

To make possible the displacement of individual layers, provision is also made for corresponding oblique faces of the shaped blocks of a layer of the retaining wall to diverge on the upper side and lower side in the direction of the rear side, and for the corresponding oblique faces of the shaped blocks of adjacent layers of the retaining wall to converge on the upper side and lower side in the direction of the rear side. This makes it possible when lateral pressure is exerted on individual layers for the pressure to be distributed to adjacent layers, and, at the same time, direct pressure exerted on individual layers arranged in a targeted manner can bring about a displacement of the corresponding layer and thus relieve the stress relative to the loading variation. Of course, the geometric design of the shaped blocks of the layers can also be selectively reversed, with the result that corresponding oblique faces of the shaped blocks of a layer of the retaining wall converge on the upper side and lower side in the direction of the rear side and corresponding oblique faces of the shaped blocks of adjacent layers of the retaining wall diverge on the upper side and lower side in the direction of the rear side.

Another development, which may also constitute an independent invention, has the special feature that rear sides of at least some shaped blocks have means for keying with a soil backfill of the retaining wall. This can lead to a reduction in the wall friction angle, as a result of which the active earth pressure acting on the retaining wall is proportionally removed or can be reduced. In this way, the retaining wall according to the invention is able to absorb higher loads than conventional retaining walls.

In a preferred development of the above invention, provision is made for the rear sides to have a roughened and/or profiled surface in order to increase the geotechnical wall friction of the soil backfill. Preferably, projections constituting keying means and arranged at a distance from one another are formed on the rear sides of some or all shaped blocks, the projections preferably having a cube-shaped or parallelepipedal structure.

Provision is made in another development of the invention for the shaped blocks to be provided on vertical side faces thereof with means for keying with adjacent shaped blocks of the same layer, in particular corresponding splines and/or projections which preferably interlock in a form-fitting manner.

Provision is made in yet another development of the invention for the retaining wall to be formed from a plurality of different block types, the block types having differently formed visible sides while being of substantially corresponding configuration and dimensions.

The shaped blocks according to the invention are not only suitable for constructing retaining walls but also for constructing walls in general, for example free-standing walls or curtain facades etc. Furthermore, the shaped blocks are suitable for constructing ground coverings. In this respect, protection is also claimed for such intended uses, and also for a kit composed of shaped blocks according to the invention.

Further details and preferred developments of the invention will become apparent from the subclaims and the remainder of the description.

BRIEF DESCRIPTION OF THE DRAWINGS

A preferred exemplary embodiment of the invention will be described below with reference to the drawing, in which:

FIG. 2 shows a plan view of the shaped block according to FIG. 1.

FIG. 3 shows a side view of the visible side of the shaped block according to FIG. 1.

FIGS. 6 to 8 show the shaped block according to FIG. 5 in representations according to FIGS. 2 to 4.

FIGS. 10 to 12 show the shaped block according to FIG. 9 in representations according to FIGS. 2-4.

DETAILED DESCRIPTION OF PREFERRED EMBODIMENTS

Figure 1:
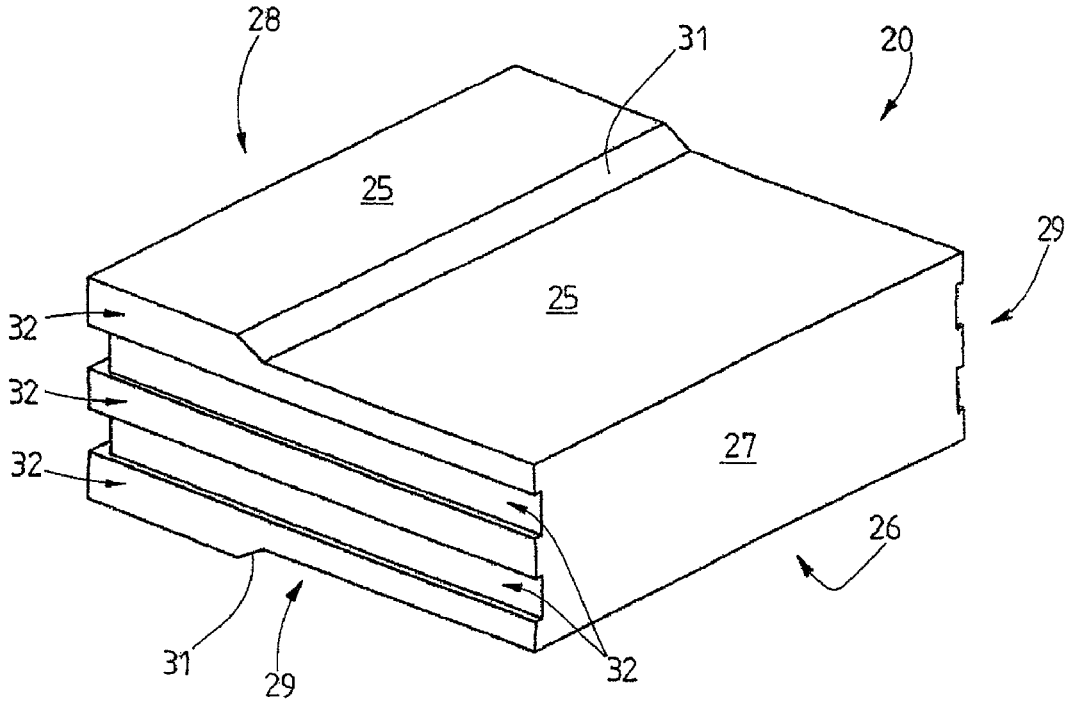
FIG. 1 shows a three-dimensional representation of a shaped block for a retaining wall.
Figure 4:
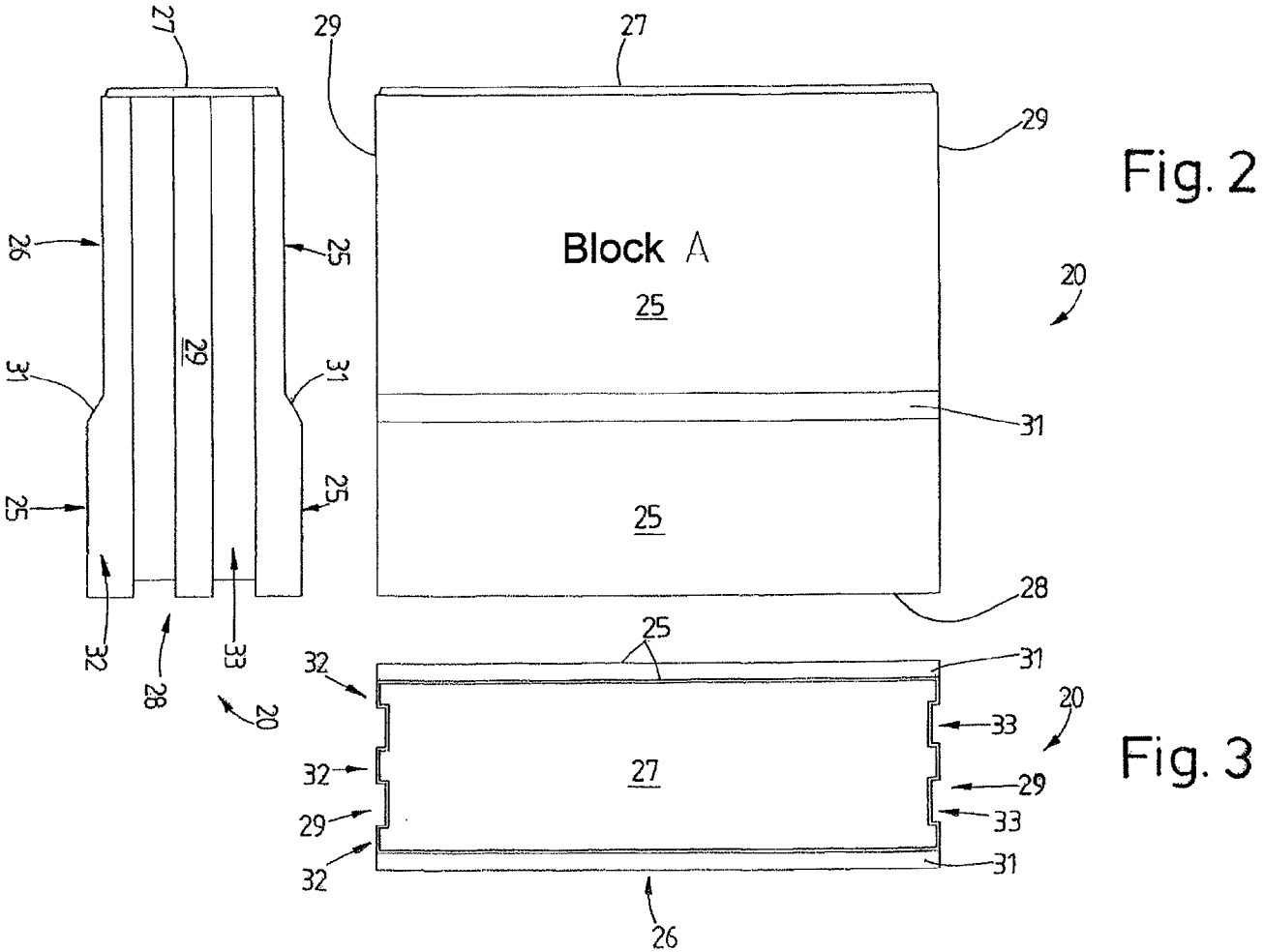
FIG. 4 shows a side view of the shaped block according to FIG. 1.
Figure 5:
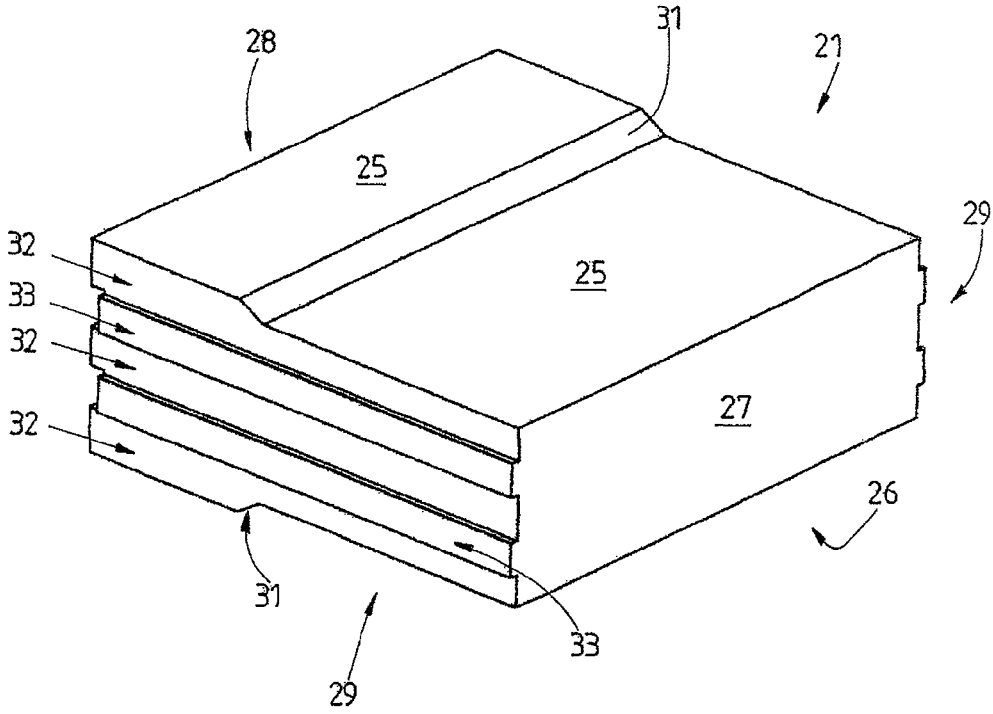
FIG. 5 is a three-dimensional representation showing a further shaped block for a retaining wall.
Figure 9:
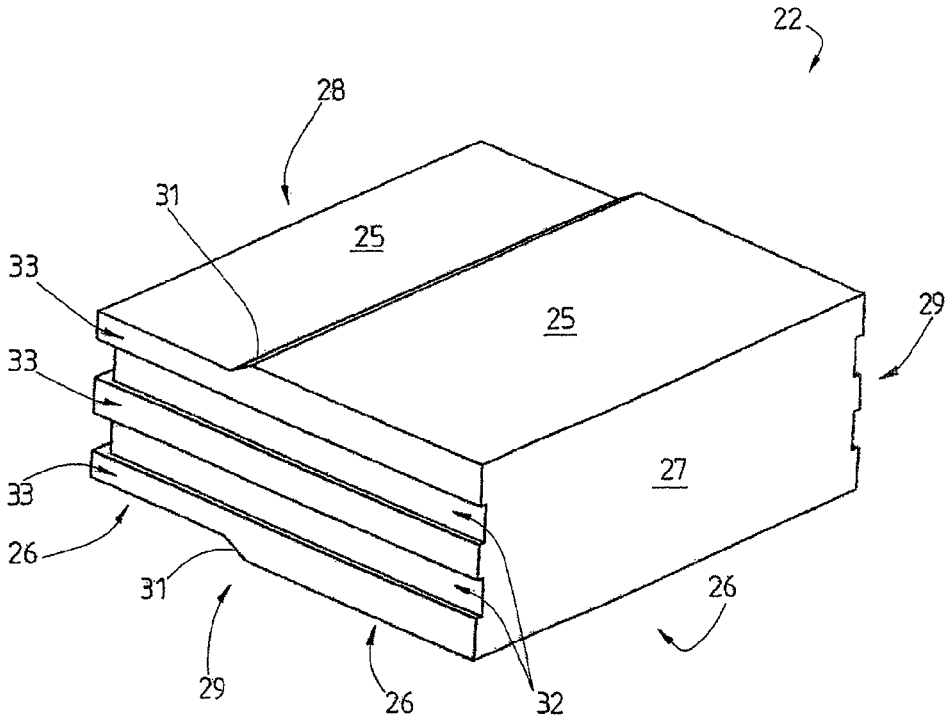
FIG. 9 is a three-dimensional representation of a third shaped block for a retaining wall.
Figure 13:
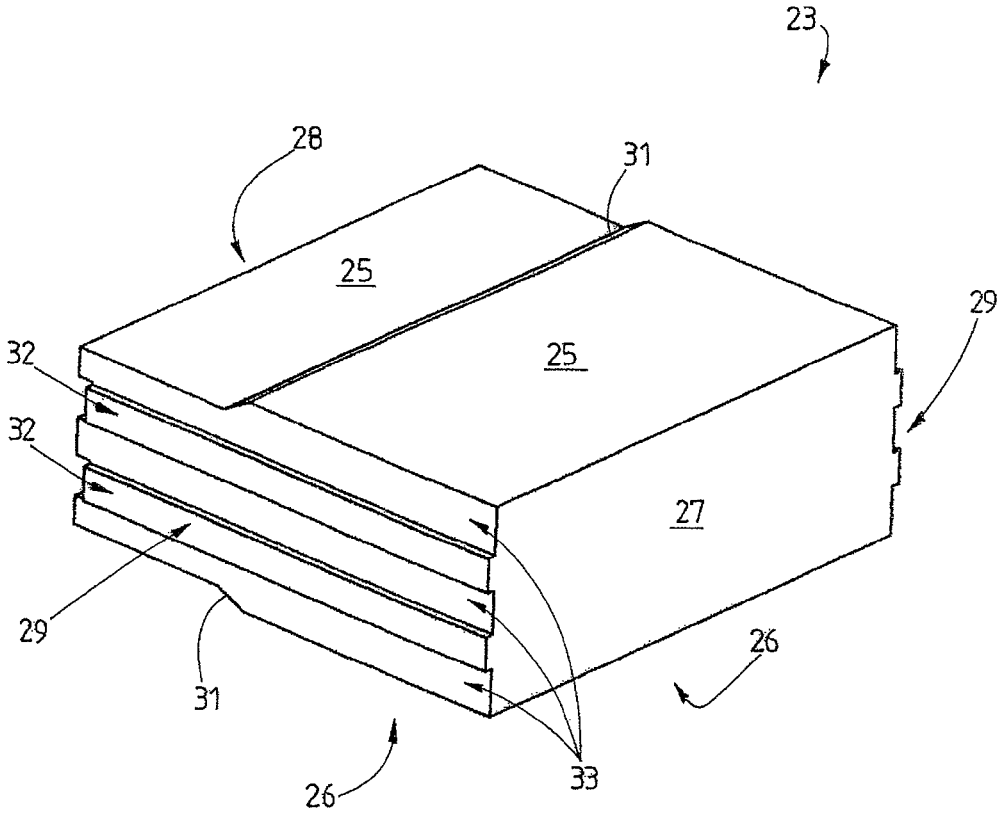
FIG. 13 is a three-dimensional representation of a fourth shaped block for a retaining wall.
Figures 14, 15, 16:
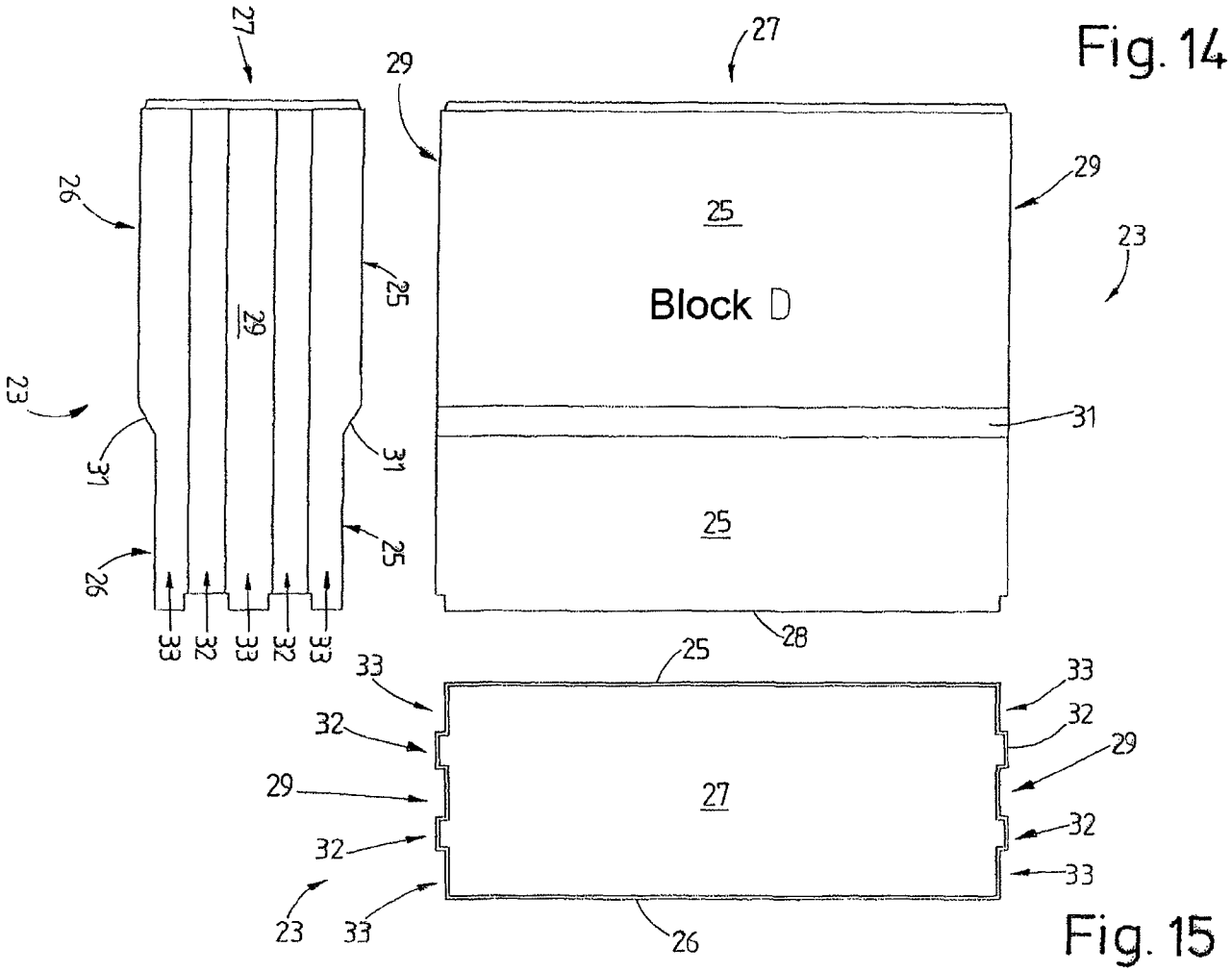
FIGS. 14 to 16 show the shaped block according to FIG. 13 in representations according to FIGS. 2-4.

The shaped blocks 20, 21, 22, 23 represented in FIGS. 1 to 18 are used for producing a retaining wall 24. The shaped blocks 20, 21, 22, 23 are preferably made of concrete and have an upper side 25, a lower side 26, a vertical visible side 27, a vertical rear side 28 and two vertical side faces 29. The visible sides 27 of the shaped blocks 20, 21, 22, 23 form a corresponding visible side of the retaining wall 24, whereas the rear sides 28 of the shaped blocks 20, 21,22, 23 usually face a soil backfill (not shown). The two remaining side faces 29 extend between the visible side 27 and rear side 28 on the one hand and between the upper side 25 and lower side 26 on the other hand.

Figure 17:
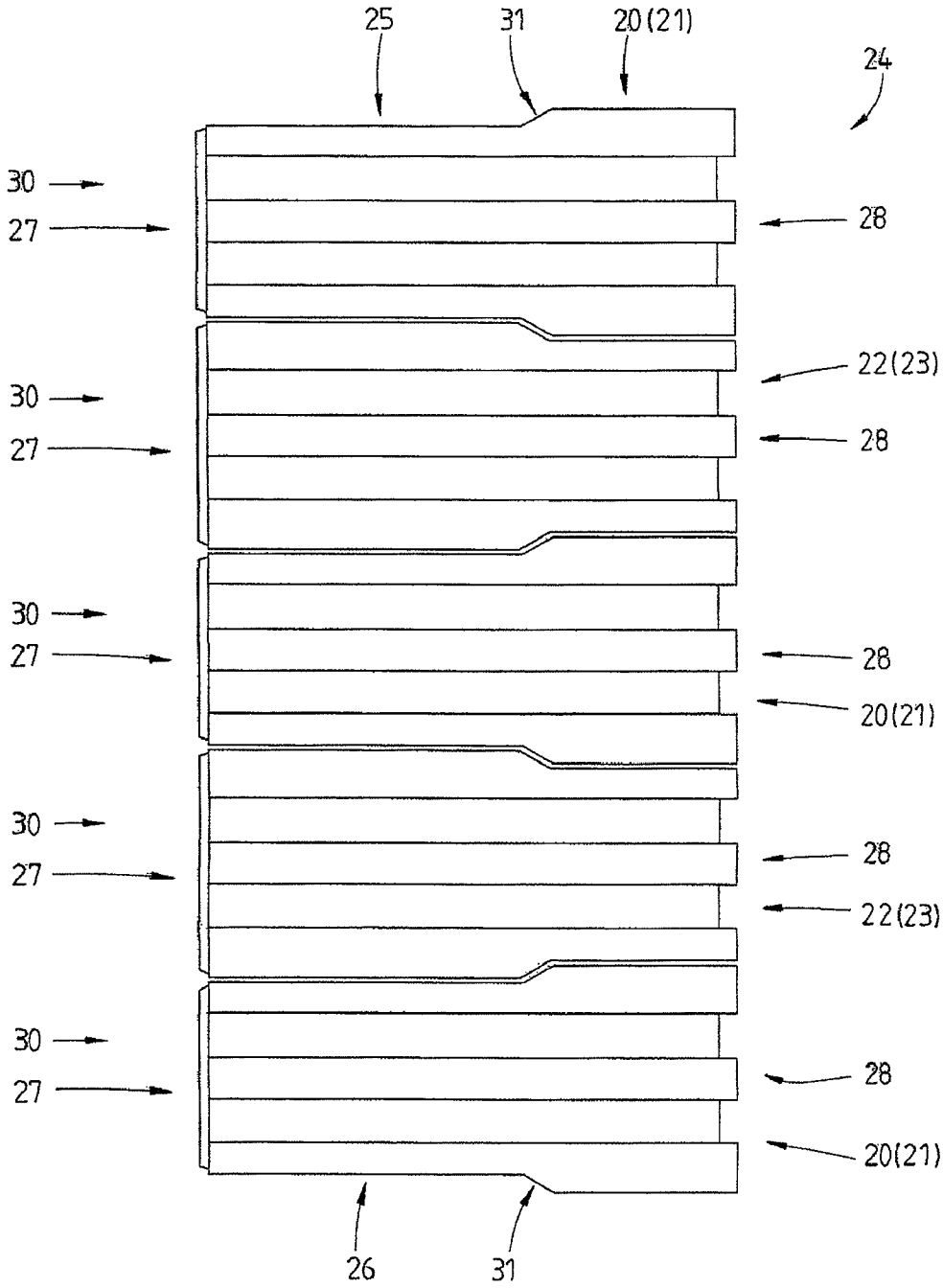
FIG. 17 shows a retaining wall composed of shaped blocks in a side view or a vertical section.

The retaining wall 24 can, as shown in FIG. 17, be a substantially vertical retaining wall 24. However, the retaining wall 24 can also be formed as a retaining wall 24 which is inclined with respect to an imaginary vertical plane.

Within the retaining wall 24 the shaped blocks 20, 21, 22, 23 are arranged one above the other in layers 30. The shaped blocks 20, 21, 22, 23 of adjacent layers 30 engage in a form-fitting manner with one another here. The form-fitting engagement is produced by mutually facing upper sides 25 and lower sides 26 of adjacent shaped blocks 20, 21, 22, 23 bearing correspondingly on one another.

To produce the form fit, the shaped blocks 20, 21, 22, 23 have form-fitting means in the region of the upper side 25 and the lower side 26. The form-fitting means can be any desired means which provide a form fit between the layers 30 of shaped blocks 20, 21, 22, 23 such that loading, in particular from the soil backfill, can be transferred from a layer 30 to adjacent layers 30.

In the exemplary embodiment shown here, the form-fitting means are formed as a result of the upper sides 25 and the lower sides 26 each being arranged in a plurality of mutually offset planes between which oblique faces 31 extend. The oblique faces 31 are each arranged at a distance from the visible side 27 or the rear side 28. In the present exemplary embodiment, the distances separating the oblique faces 31 from the visible sides 27 and from the rear sides 28 are chosen to correspond to one another for all the shaped blocks 20, 21, 22, 23. In this way, the oblique faces 31 of shaped blocks 20, 21, 22, 23 of adjacent layers 30 bear correspondingly against one another.

As can be seen from FIG. 17, each of the individual layers 30 contains different shaped blocks 20, 21, 22, 23. In the present case, the uppermost layer 30 according to FIG. 17 consists of shaped blocks 20, 21, whereas the layer 30 arranged below consists of shaped blocks 22, 23. The next layer 30 below the above-described layer 30 in turn consists of shaped blocks 20, 21 etc. The reason behind this arrangement is as follows: the shaped blocks 20, 21 each have oblique faces 31 on the upper side 25 and on the lower side 26 which are designed to diverge towards the rear side 28. Correspondingly, the oblique faces 31 on the upper side 25 and lower side 26 converge towards the visible side 27. By contrast, the shaped blocks 22, 23 are designed so that the oblique faces 31 on the upper side 25 and the lower side 26 converge towards the rear side 28 and diverge towards the visible side 27. In this way, the oblique faces 31 of adjacent shaped blocks 20, 21, 22, 23 bear in a form-fitting manner against one another in such a way that obliquely or transversely directed loads, that is, for example, lateral pressure from the soil backfill, can be distributed to adjacent layers 30. It is thus possible, for example, for lateral pressure exerted on the rear side 28 of the shaped blocks 20, 21 of the uppermost layer 30 of the retaining wall 24 according to FIG. 17 to be transferred via the oblique face 31 in the region of the lower side 26 to the form-fittingly bearing oblique face 31 in the region of the upper side 25 of the underlying layer 30 composed of shaped blocks 22, 23. In this way, the horizontal pressure is distributed to the layer arranged below the uppermost layer 30. Correspondingly, lateral pressure exerted on the central layer 30 of shaped blocks 20, 21 shown in FIG. 17 is distributed to the layers 30 of shaped blocks 22, 23 arranged below and above, namely in each case via the corresponding oblique faces 31 in the region of the upper sides 25 and lower sides 26.

The above-described arrangement or configuration of the shaped blocks 20, 21, 22, 23 also provides a further special feature. The fact that the shaped blocks 22, 23 have oblique faces 31 which diverge towards the visible side 27 means that lateral pressure exerted on the rear side 28 cannot be transmitted via the oblique faces 31 to other layers 30 of shaped blocks 20, 21. To transfer such pressure, only the frictional forces between the layers, and any mortaring of the layers 30, is then available. As a consequence of this specific arrangement of the shaped blocks 20, 21, 22, 23, it is possible for one or more layers 30 to slide out from the retaining wall axis (transversely to the longitudinal axis of the retaining wall) under excessively high lateral pressure and thus contribute to stress relief. In this way, destruction of the whole retaining wall 24 is counteracted.

It is conceivable here for only a single layer 30 of shaped blocks 22, 23 to be moved or displaced laterally. However, it is also conceivable for a group of layers 30 to be pushed out, for example a layer 30 of shaped blocks 22, 23, a layer 30 of shaped blocks 20, 21 arranged above it, and a further layer 30 of shaped blocks 22, 23 arranged above. Given the above-described alternating laying arrangement, it is thus always possible for assemblies containing 3, 5, 7, etc., layers 30 within a retaining wall 24 to be displaced.

However, it is also conceivable for an upper section of the retaining wall 24, that is an uppermost shaped block 20, 21, 22, 23, to be displaced continuously to a designated depth of the retaining wall 24.

As described above, the layers 30 each exclusively consist of shaped blocks 20, 21 on the one hand or shaped blocks 22, 23 on the other hand. Each layer 30 of the retaining wall 24 thus consists, with respect to the arrangement and/or orientation of the oblique faces 31, of identical shaped blocks 20, 21; 22, 23.

The difference between the shaped blocks 20 and 21 is merely the fact that they are designed differently with regard to a profiling of the two side faces 29. As can be seen from FIGS. 1 to 8, the shaped blocks 20, 21 are provided in the region of the two vertical side faces 29 with means for keying with adjacent shaped blocks 20, 21 within the same layer 30. The keying means on the two shaped blocks 20, 21 are correspondingly designed here, resulting in a form fit in the region of the side faces 29 when the shaped blocks 20, 21 are laid next to one another within the same layer 30. In the present case, the keying means are designed as horizontally extending and projecting splines 32 and corresponding depressions 33. The splines 32 and depressions 33 extend alternately and continuously over the whole of the side faces 29. The splines 32 and depressions 33 are oriented parallel to one another.

The shaped blocks 22, 23 also have corresponding splines and depressions 33 which correspond to one another, with the result that adjacent shaped blocks 22, 23 within a layer 30 can be laid together by being keyed with one another.

A further special feature of the shaped blocks 20, 21, 22, 23 shown concerns a particular configuration of the rear sides 28 of all the shaped blocks 20, 21, 22, 23. Specifically, the rear sides 28 have means for keying the shaped blocks 20, 21, 22, 23, or a corresponding face of the retaining wall 24, with a soil backfill (not shown).

For this purpose, the rear sides 28 have a roughened and/or profiled surface. Preferably, however, projections, for example as a continuation of the splines 32 on the side faces 29, are formed at a distance from one another on the rear sides 28. However, it is also conceivable for the projections not to be formed continuously but to be integrally formed on the rear side 28 as cubes or parallelepipedal structures. This leads to a reduction in the wall friction angle, as a result of which the active earth pressure acting on the retaining wall 24 is proportionally removed or can be reduced. In this way, the retaining wall 24 described can absorb higher loads than conventional retaining walls.

A further special feature concerns the configuration of the visible sides 27 of the shaped blocks 20, 21, 22, 23. As is apparent from what was described above, the retaining wall is produced from a total of four differently designed shaped blocks 20, 21, 22, 23. In this connection, two differently designed shaped blocks 20, 21 on the one hand or two differently designed shaped blocks 22, 23 on the other hand are used in each layer 30. However, the visible sides 27 of the four shaped blocks 20, 21, 22, 23 are designed to deviate from one another as a whole.

Figure 18:
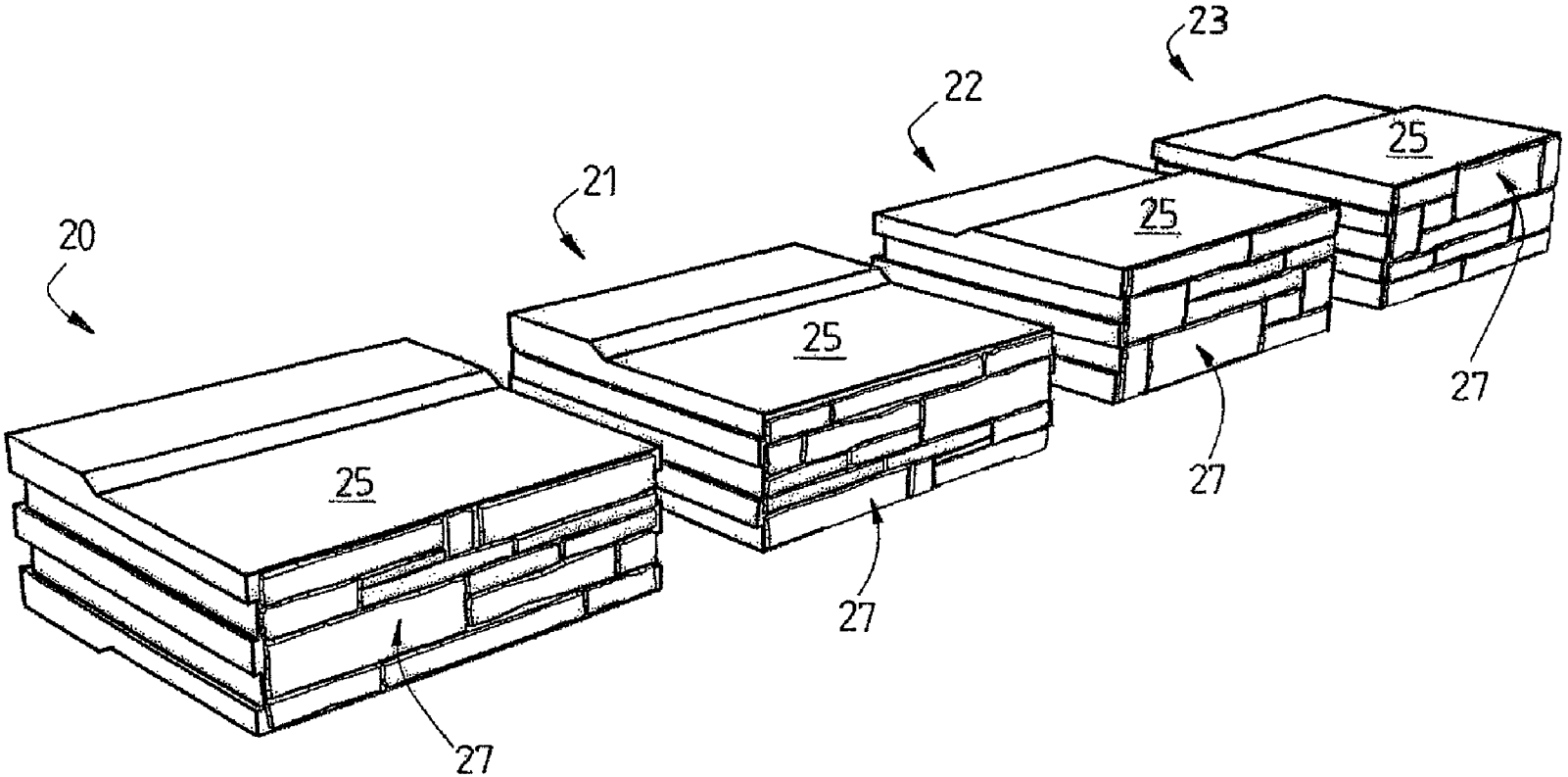
FIG. 18 is a three-dimensional representation of the shaped blocks according to FIGS. 1 to 16 in the region of the visible sides.

In the exemplary embodiment according to FIG. 18, the visible sides 27 have a mosaic-like imprint. However, other effects can also be provided in order to give the visible sides 27 a different configuration. It is also conceivable for the visible sides 27 to be formed by differently configured attachment elements.

The advantage of this solution is that the retaining wall 24 has an aesthetic appearance on the one hand while suffering no losses in stability on the other hand.

A further special feature is the fact that, with respect to the keying means and the form-fitting means, the shaped blocks 20, 21, 22, 23 are formed symmetrically to an imaginary horizontal center plane. In this way, the shaped blocks 20, 21, 22, 23, without dispensing with the aforementioned functionalities, can be laid either with the upper side 25 pointing upwards or with the upper side 25 pointing downwards. This makes it possible to have a varied configuration of the visible side 27 of the retaining wall 24 without the appearance of uniform patterns or any moiré effect.

The above-described special features of the shaped blocks 20, 21, 22, 23 can be implemented independently or cumulatively. In particular, any desired combinations of the special features are possible.

With regard to the formation of the oblique faces 31, it is of course also conceivable for the oblique faces 31 to extend continuously from the visible side 27 to the rear side 28, with the result that the shaped blocks 20, 21, 22, 23 have a trapezoidal shape in cross section. Of course, it is also conceivable for the oblique faces 31 to extend starting from the visible side 27 and terminate at a distance from the rear side 28, or vice versa. It is important only that some layers of shaped blocks 20, 21, 22, 23 can transfer lateral pressure from the soil backfill to some other layers 30, whereas this is not provided in other layers 30 of shaped blocks 20, 21, 22, 23.

The above-described set of shaped blocks 20, 21, 22, 23 is also suitable for the construction of walls in general (in particular free-standing walls) and also curtain facades or the like. In this case, the shaped blocks 20, 21, 22, 23 can be designed as described above.

Furthermore, the shaped blocks 20, 21, 22, 23 are also suitable for the construction of ground coverings or soil coverings, in which case the shaped blocks 20, 21, 22, 23 are laid together according to the above description, although the visible sides 27 of the shaped blocks 20, 21, 22, 23 point upwards and form the paved area.

The above-described kit of (four) shaped blocks 20, 21, 22, 23 can thus be variously employed, for example for constructing retaining walls 24, walls, ground coverings, etc.

LIST OF REFERENCE NUMBERS

20 Shaped block
21 Shaped block
22 Shaped block
23 Shaped block
24 Retaining wall
25 Upper side
26 Lower side
27 Visible side
28 Rear side
29 Side face
30 Layer
31 Oblique face
32 Spline
33 Depression

What is claimed is:

1. A retaining wall, in particular a retaining wall (24) inclined against a soil backfill, comprising individual shaped blocks (20, 21, 22, 23), the shaped blocks being arranged one above the other in layers (30) and the shaped blocks of adjacent layers (30) each engaging in a form-fitting manner with one another in the region of upper sides (25) and lower sides (26) of the shaped blocks, wherein:

the upper sides (25) and the lower sides (26) of the shaped blocks are designed and/or oriented in such a way that when lateral pressure is exerted transversely to an imaginary longitudinal axis of the retaining wall (24), individual layers (30) can be displaced in the corresponding direction;

corresponding oblique faces (31) of the shaped blocks of a layer (30) of the retaining wall (24) diverge on the upper side (25) and the lower side (26) in the direction of a rear side (28) of the shaped blocks; and corresponding oblique faces (31) of the shaped blocks of adjacent layers (30) of the retaining wall (24) converge on the upper side (25) and the lower side (26) in the direction of the rear side (28).

2. The retaining wall according to claim 1, wherein the shaped blocks (20, 21; 22, 23) arranged in the same layer (30) of the retaining wall (24) are designed to deviate from the shaped blocks of the respective adjacent layers (30) in order to make possible the displacement of individual layers (30).

3. The retaining wall according to claim 1, wherein the shaped blocks are provided in the region of the upper side (25) and the lower side (26) with respective form-fitting means for the form-fitting engagement of the shaped blocks of adjacent layers (30) transversely to the longitudinal axis of the retaining wall.

4. The retaining wall according to claim 3, wherein the shaped blocks of one and the same layer (30) of the retaining wall (24) are correspondingly designed with respect to the form-fitting means.

5. The retaining wall according to claim 3, wherein the form-fitting means of the shaped blocks of adjacent layers (30) are designed to correspond to one another, the form-fitting means of the shaped blocks of individual layers (30) being designed in such a way that when lateral pressure is exerted on an upper or lower layer of the layers (30), the pressure can be transmitted via the form-fitting means to the shaped blocks of adjacent central layer of the layers (30), and in that the form-fitting means of the shaped blocks of other layers (30) are designed so that they absorb pressure from the shaped blocks of adjacent layers (30) but can be displaced from the wall axis under direct lateral pressure.

6. The retaining wall according to claim 1, wherein the upper side (25) and the lower side (26) of the shaped blocks have respective oblique faces (31) formed thereon for form-fitting engagement with shaped blocks of adjacent layers (30), the oblique faces (31) each being arranged at a distance from a visible side (27) and a rear side (28) of the shaped blocks.

7. The retaining wall according to claim 1, wherein the rear sides (28) of at least some of the shaped blocks have means for keying with a soil backfill of the retaining wall (24).

8. The retaining wall according to claim 7, wherein the rear sides (28) have a roughened and/or profiled surface.

9. The retaining wall according to claim 1, further comprising projections formed on the rear sides (28) of some or all of the shaped blocks, the projections situated at a distance from one another and constitute keying means.

10. The retaining wall according to claim 1, wherein the shaped blocks are provided on vertical side faces (29) thereof with means for keying with adjacent shaped blocks of the same layer (30).

11. The retaining wall according to claim 10, wherein the keying means on the side faces (29) each extend over at least the substantially whole respective side face (29).

12. The retaining wall according to claim 1, wherein the retaining wall (24) is formed from a plurality of different block types, the block types having differently formed visible sides (27) while being of substantially corresponding configuration and dimensions.

13. The retaining wall according to claim 12, wherein the block types can be laid in the layers (30) either with the upper side (25) or with the lower side (26) pointing upwards, the form-fitting means and/or the keying means being designed and/or arranged in such a way that there is a form fit between shaped blocks of adjacent layers (30) or between adjacent shaped blocks of the same layer (30).

14. A wall composed of shaped blocks according to claim 1.

15. A kit composed of shaped blocks according to claim 1 for constructing retaining walls (24) and/or walls and/or ground coverings.

16. A ground covering, in particular soil covering, composed of shaped blocks (20, 21, 22, 23), the shaped blocks each engaging in a form-fitting manner with one another in the region of upper sides (25) and lower sides (26) of the shaped blocks, wherein:

the upper sides (25) and the lower sides (26) of the shaped blocks are designed and/or oriented in such a way that when lateral pressure is exerted transversely to an imaginary longitudinal axis of the retaining wall (24), individual layers (30) can be displaced in the corresponding direction;

corresponding oblique faces (31) of the shaped blocks of a layer (30) of the retaining wall (24) diverge on the upper side (25) and the lower side (26) in the direction of a rear side (28) of the shaped blocks; and corresponding oblique faces (31) of the shaped blocks of adjacent layers (30) of the retaining wall (24) converge on the upper side (25) and the lower side (26) in the direction of the rear side (28).

17. A retaining wall, in particular a retaining wall (24) inclined against a soil backfill, comprising individual shaped blocks (20, 21, 22, 23), the shaped blocks being arranged one above the other in layers (30) and the shaped blocks of adjacent layers (30) each engaging in a form-fitting manner with one another in the region of upper sides (25) and lower sides (26) of the shaped blocks, wherein:

the upper sides (25) and the lower sides (26) of the shaped blocks are designed and/or oriented in such a way that when lateral pressure is exerted transversely to an imaginary longitudinal axis of the retaining wall (24), individual layers (30) can be displaced in the corresponding direction;

corresponding oblique faces (31) of the shaped blocks of a layer (30) of the retaining wall (24) converge on the upper side (25) and the lower side (26) in the direction of a rear side (28) of the shaped blocks; and corresponding oblique faces (31) of the shaped blocks of adjacent layers (30) of the retaining wall (24) diverge on the upper side (25) and the lower side (26) in the direction of the rear side (28).

18. The retaining wall according to claim 17, wherein the shaped blocks (20, 21; 22, 23) arranged in the same layer (30) of the retaining wall (24) are designed to deviate from the shaped blocks of the respective adjacent layers (30) in order to make possible the displacement of individual layers (30).

19. The retaining wall according to claim 17, wherein the shaped blocks are provided in the region of the upper side (25) and the lower side (26) with respective form-fitting means for the form-fitting engagement of the shaped blocks of adjacent layers (30) transversely to the longitudinal axis of the retaining wall.

20. The retaining wall according to claim 19, wherein the shaped blocks of one and the same layer (30) of the retaining wall (24) are correspondingly designed with respect to the form-fitting means.

21. The retaining wall according to claim 19, wherein the form-fitting means of the shaped blocks of adjacent layers (30) are designed to correspond to one another, the form-fitting means of the shaped blocks of individual layers (30) being designed in such a way that when lateral pressure is exerted on an upper or lower layer of the layers (30), the pressure can be transmitted via the form-fitting means to the shaped blocks of adjacent central layer of the layers (30), and in that the form-fitting means of the shaped blocks of other layers (30) are designed so that they absorb pressure from the shaped blocks of adjacent layers (30) but can be displaced from the wall axis under direct lateral pressure.

22. The retaining wall according to claim 17, wherein the upper side (25) and the lower side (26) of the shaped blocks have respective oblique faces (31) formed thereon for form-fitting engagement with shaped blocks of adjacent layers (30), the oblique faces (31) each being arranged at a distance from a visible side (27) and a rear side (28) of the shaped blocks.

23. The retaining wall according to claim 17, wherein the rear sides (28) of at least some of the shaped blocks have means for keying with a soil backfill of the retaining wall (24).

24. The retaining wall according to claim 23, wherein the rear sides (28) have a roughened and/or profiled surface.

25. The retaining wall according to claim 17, further comprising projections formed on the rear sides (28) of some or all of the shaped blocks, the projections situated at a distance from one another and constitute keying means.

26. The retaining wall according to claim 17, wherein the shaped blocks are provided on vertical side faces (29) thereof with means for keying with adjacent shaped blocks of the same layer (30).

27. The retaining wall according to claim 26, wherein the keying means on the side faces (29) each extend over at least the substantially whole respective side face (29).

28. The retaining wall according to claim 17, wherein the retaining wall (24) is formed from a plurality of different block types, the block types having differently formed visible sides (27) while being of substantially corresponding configuration and dimensions.

29. The retaining wall according to claim 28, wherein the block types can be laid in the layers (30) either with the upper side (25) or with the lower side (26) pointing upwards, the form-fitting means and/or the keying means being designed and/or arranged in such a way that there is a form fit between shaped blocks of adjacent layers (30) or between adjacent shaped blocks of the same layer (30).

30. A wall composed of shaped blocks according to claim 17.

31. A kit composed of shaped blocks according to claim 17 for constructing retaining walls (24) and/or walls and/or ground coverings.

32. A ground covering, in particular soil covering, composed of shaped blocks (20, 21, 22, 23), the shaped blocks each engaging in a form-fitting manner with one another in the region of upper sides (25) and lower sides (26) of the shaped blocks, wherein:

the upper sides (25) and the lower sides (26) of the shaped blocks are designed and/or oriented in such a way that when lateral pressure is exerted transversely to an imaginary longitudinal axis of the retaining wall (24), individual layers (30) can be displaced in the corresponding direction;

corresponding oblique faces (31) of the shaped blocks of a layer (30) of the retaining wall (24) converge on the upper side (25) and the lower side (26) in the direction of a rear side (28) of the shaped blocks; and corresponding oblique faces (31) of the shaped blocks of adjacent layers (30) of the retaining wall (24) converge on the upper side (25) and the lower side (26) in the direction of the rear side (28).

* * * * *